US007181851B2

(12) United States Patent
Theurer et al.

(10) Patent No.: US 7,181,851 B2
(45) Date of Patent: Feb. 27, 2007

(54) METHOD OF TRACKING A TRACK GEOMETRY

(75) Inventors: Josef Theurer, Vienna (AT); Bernhard Lichtberger, Linz (AT); Herbert Wörgötter, Gallneukirchen (AT)

(73) Assignee: Franz Plasser Bahnbaumaschinen Gesellschaft mbH, Vienna (AT)

( * ) Notice: Subject to any disclaimer, the term of this patent is extended or adjusted under 35 U.S.C. 154(b) by 2 days.

(21) Appl. No.: 11/205,707

(22) Filed: Aug. 17, 2005

(65) Prior Publication Data

US 2006/0059697 A1 Mar. 23, 2006

(30) Foreign Application Priority Data

Sep. 22, 2004 (AT) ..... 1588/2004

(51) Int. Cl.
*E01B 35/00* (2006.01)
*E01B 27/00* (2006.01)
*E01B 29/04* (2006.01)

(52) U.S. Cl. ..... 33/1 Q; 33/287; 33/651; 104/2

(58) Field of Classification Search ..... 33/1 Q, 33/287, 338, 521, 651
See application file for complete search history.

(56) References Cited

U.S. PATENT DOCUMENTS 4,497,255 A * 2/1985 Theurer ..... 33/1 Q
4,574,704 A 3/1986 Cicin-Sain ..... 33/287
5,012,413 A * 4/1991 Sroka et al. ..... 33/287
6,154,973 A * 12/2000 Theurer et al. ..... 33/651
6,158,352 A * 12/2000 Theurer et al. ..... 33/287
6,260,485 B1 * 7/2001 Theurer et al. ..... 33/287
6,311,624 B1 * 11/2001 Theurer et al. ..... 33/287
6,634,112 B2 * 10/2003 Carr et al. ..... 33/287
7,050,926 B2 * 5/2006 Theurer et al. ..... 33/287

* cited by examiner

*Primary Examiner*—Christopher W. Fulton
(74) *Attorney, Agent, or Firm*—Laurence A. Greenberg; Werner H. Stemer; Ralph E. Locher

(57) ABSTRACT

In a method of tracing a track geometry immediately ahead of a ballast pick-up device of a cleaning machine in a working direction, a first and a second measuring chord are guided on the track by a respective front and rear end point. A versine measured by a first versine sensor of the first measuring chord is stored, in connection with a distance measurement, for registering the rear end point of the first measuring chord as a desired position with respect to a local track point. After the rear end point of the second measuring chord has reached the local track point, the rear end point is displaced until a measurement value corresponding to the stored versine is reached by a second versine sensor, and thus the desired position has been attained.

2 Claims, 1 Drawing Sheet

METHOD OF TRACKING A TRACK GEOMETRY

BACKGROUND OF THE INVENTION

1. Field of the Invention

The present invention relates, in general, to a method of tracing the geometry of a track immediately ahead of a ballast pick-up device, with respect to a working direction, and of restoring said geometry after it has been destroyed by the operation of said ballast pick-up device. The invention also relates to a machine for cleaning ballast.

2. Description of Related Art

A method of the afore-mentioned type is known from U.S. Pat. No. 4,574,704. When a ballast cleaning machine excavates the ballast underneath a track, the track geometry is necessarily destroyed. Restoring that geometry after introducing the cleaned ballast is problematic. According to the prior art method, the position of a first measuring chord—situated ahead of the ballast pick-up device with regard to the working direction—follows the track geometry. This position is used as a reference to guide a second, trailing measuring chord. To that end, a vector height of the first measuring chord is measured, and an angle enclosed by the two measuring chords is recorded. A track lifting device then displaces the track in the transverse direction until a rear end point of the second measuring chord, after the angle has been attained, comes to lie in the desired position. That method, however, is applicable only in a track curve. For working in transition curves, a correction factor must be taken into account.

SUMMARY OF THE INVENTION

It is an object of the present invention to provide a method of the specified kind that overcomes the disadvantages of the heretofore-known methods of this general type, and with which the geometry of a track can be restored without problems in a relatively simple manner.

With the foregoing and other objects in view there is provided, in accordance with the present invention, a method of tracing the geometry of a track immediately ahead of a ballast pick-up device, with respect to a working direction, and of restoring said geometry after it has been destroyed by the operation of said ballast pick-up device. The method comprises the steps of moving a first measuring chord along the track, the first measuring chord having a front end point and a rear end point running on the track; measuring a versine of the first measuring chord by means of a versine sensor associated with the first measuring chord; storing a measurement value corresponding to said versine in connection with a measurement of the distance traveled, thus registering the rear end point of the first measuring chord as a desired position with respect to a local track point; moving a second measuring chord along the track, the second measuring chord following the first measuring chord in the working direction and having a front end point and a rear end point running on the track; and correcting the track geometry by displacing, in the transverse direction of the track, the rear end point of the second measuring chord when said rear end point reaches the local track point, while measuring, by means of a second versine sensor associated with the second measuring chord, a versine of the second measuring chord until a corresponding measurement value coincides with the stored measurement value, thus indicating that the desired position has been reached.

With the foregoing and other objects in view there is also provided, in accordance with the invention, a machine for cleaning ballast supporting a track. The machine is mobile on the track in a working direction and comprises an excavating car including a vertically adjustable track lifting device and a ballast pick-up device; a screening car arranged ahead of the excavating car in the working direction; and a track measurement system. The latter comprises a first measuring chord associated with the screening car and a second measuring chord associated with the excavating car, the second measuring chord having a rear end point with respect to the working direction; a first versine sensor associated with the first measuring chord, and a second versine sensor associated with the second measuring chord; and an odometer and a memory unit for storing, in dependence on the distance travelled, a measurement value registered by the first versine sensor and for comparing said measurement value to a measurement value registered by the second versine sensor.

A solution of this kind offers the advantage that it is now possible without problems to copy the track geometry for the restoration thereof after the reintroduction of the cleaned ballast. During this, in an advantageous manner, it is now totally irrelevant whether the track section to be treated is part of a track curve or of a transition curve.

Other features which are considered as characteristic for the invention are set forth in the appended claims.

Although the invention is illustrated and described herein as embodied in a method of tracing a track geometry, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE PREFERRED EMBODIMENT

Figure 1:
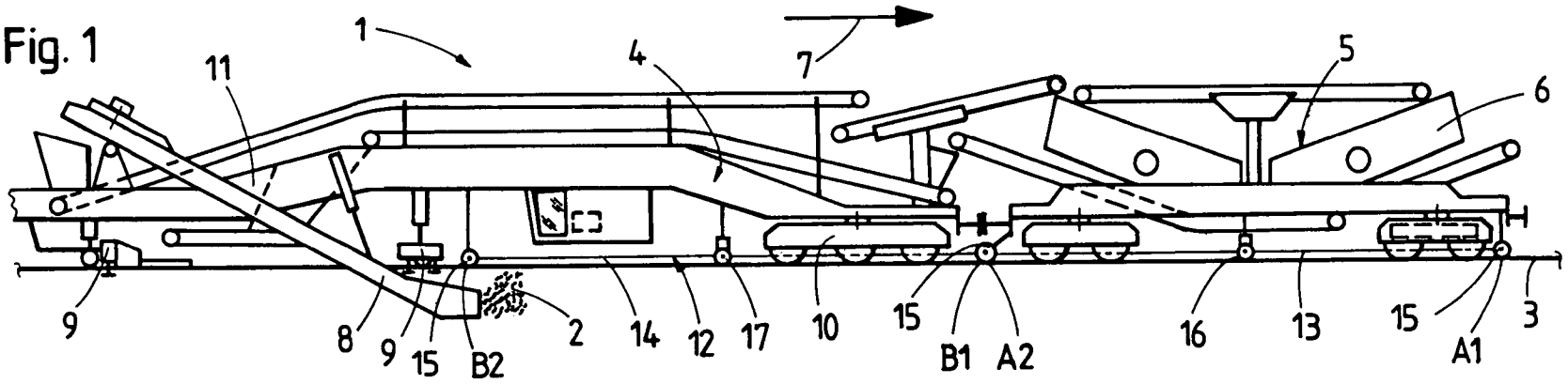
FIG. 1 shows a simplified side view of a cleaning machine including a track measurement system.

Turning now to the figures of the drawing and first, particularly, to FIG. 1 thereof, there is shown a cleaning machine 1 for cleaning ballast 2 of a track 3. The machine 1 includes of an excavating car 4 and a screening car 5 coupled thereto. The screening car 4 is equipped with a screening unit 6 for cleaning the excavated ballast. The excavating car 4, following behind the screening car 5 with respect to a working direction 7, comprises a machine frame 11, mobile on the track 3 by means of on-track undercarriages 10, and a ballast pick-up device 8 guided around the track 3, with a first track lifting device 9 being associated with said ballast pick-up device 8. A second track lifting device 9 is connected to the machine frame 11 in front of a rearward on-track undercarriage 10, which is not shown.

Figure 2:
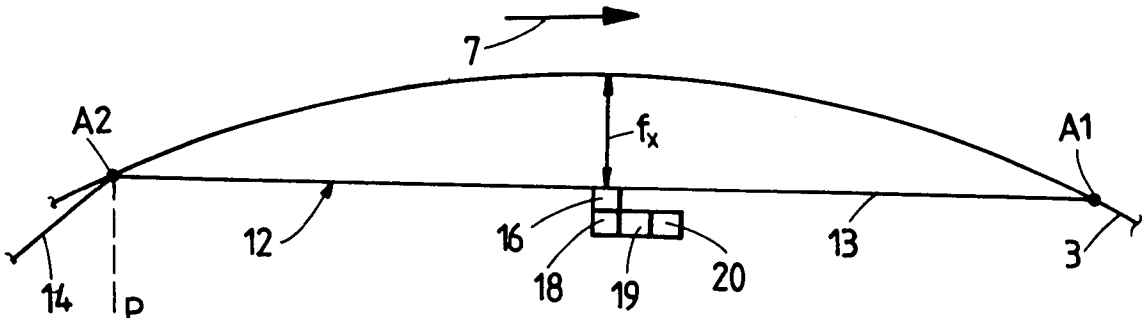
FIGS. 2 and 3 each show a schematic representation of part of the track measurement system.

The machine 1 is provided with a track measurement system 12 which consists of a first measuring chord 13—with regard to the working direction 7—and a second measuring chord 14 following behind. Both chords are configured to have the same length. As now also shown in more detail in FIGS. 2 and 3, the first measuring chord 13 has a front end point A1 and a rear end point A2, and the second measuring chord 14 has a front end point B1 and a rear end point B2. Each of said end points A1, A2, B1 and B2 is in the form of a measuring axle 15 running on the track 3. The rear end point A2 of the first measuring chord 13 and the front end point B1 of the second measuring chord 14 are formed by the same, common measuring axle 15. The rear end point B2 of the second measuring chord 14 is situated in the region of the first track lifting device 9 or in the region of a section, positioned underneath the track 3, of the ballast pick-up device 8. Arranged centrally between the two end points A1 and A2, or B1 and B2, of the two measuring chords 13 and 14 is a first versine sensor 16 and a second versine sensor 17, respectively. As indicated schematically in FIGS. 2 and 3, the track measurement system 12 also comprises a memory unit 18, a displacement measurement device or odometer 19 for registering the distance travelled by the cleaning machine 1, and a comparator 20.

The method of tracing a track geometry will now be described in more detail below.

For registering the actual position of the track 3, the track is traced continuously by the first measuring chord 13 within the scope of a pre-measurement operation. During this, a versine $f_x$ detected by the first versine sensor 16 is stored in the memory unit 18. Parallel thereto, a distance travelled and registered by the odometer 19 is also stored in order to thereby associate the rear end point A2 of the first measuring chord 13 with a local track point $P_x$.

Figure 3:
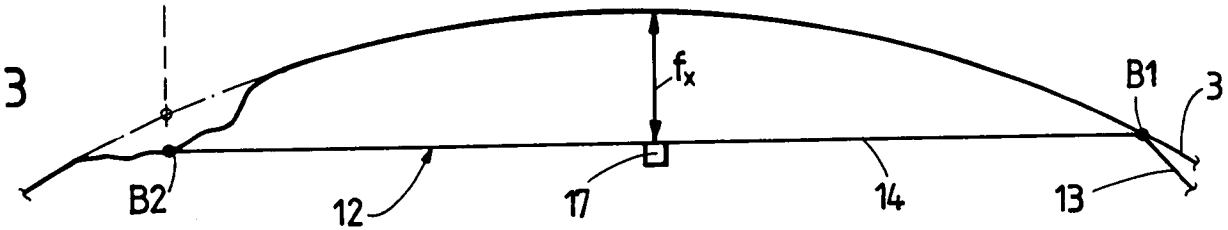

As soon as the rear end point B2 of the second measuring chord 14 has arrived at the local track point $P_x$ in the course of a working pass of the cleaning machine 1, the versine $f_x$ (sometimes referred to as an ordinate) associated—during the pre-measurement operation by the first measuring chord 13—with this track point and stored is furnished to the comparator 20. As illustrated in FIG. 3, the rear end point B2 is not situated in the desired position. As a result, the versine registered by the second versine sensor 17 of the second measuring chord 14 does not correspond to the measurement value stored and recorded in the pre-measurement operation.

With the aid of the track lifting device 9, the track 3 is now displaced in the transverse direction until the versine registered by the second versine sensor 17 corresponds to the comparative value present in the comparator 20. With that, the rear end point B2 is located precisely in the desired position registered in the course of the pre-measurement operation by the first measuring chord 13.

The most simple solution consists of configuring both measuring chords 13, 14 with chord divisions of equal length. Should the length be different, the versine registered by the first versine sensor 16 must be converted according to the prevailing geometric proportions.

In order to prevent the track geometry from drifting off as a result of inaccuracies, it is expedient to also guide the second track lifting device 9 which follows the ballast pick-up device 8. To do so, the desired geometry of the track 3 is calculated in the known manner as a positional image on the basis of the symmetrical versines of the first measuring chord 13. The position of the excavating car 4 is figured into said positional image in each case. From this position, it is possible to determine the versines of the machine frame 11 in the region of the second track lifting device 9. Said actual value of the versine is compared to the calculated versine. In case of a difference, it is possible to take adequate countermeasures by means of the second track lifting device 9.

This application claims the priority, under 35 U.S.C. § 119, of Austrian patent application No. 1588/2004, filed Sep. 22, 2004; the disclosure of the prior application is herewith incorporated by reference in its entirety.

We claim:

1. A method of tracing a geometry of a track immediately ahead of a ballast pick-up device, with respect to a working direction, and of restoring the geometry after it has been destroyed by an operation of the ballast pick-up device, the method which comprises:

moving a first measuring chord along the track, the first measuring chord having a front end point and a rear end point running on the track;

measuring a versine of the first measuring chord with a first versine sensor associated with the first measuring chord;

storing a measurement value representing the versine in connection with a measurement of a distance travelled, and thereby registering a rear end point of the first measuring chord as a desired position with respect to a local track point;

moving a second measuring chord along the track, the second measuring chord following the first measuring chord in the working direction and having a front end point and a rear end point running on the track; and correcting the track geometry by displacing, in a transverse direction of the track, the rear end point of the second measuring chord when the rear end point reaches the local track point, while measuring, with a second versine sensor associated with the second measuring chord, a versine of the second measuring chord until a corresponding measurement value coincides with the stored measurement value, thus indicating that the desired position has been reached.

2. A machine for cleaning ballast supporting a track, the machine being mobile on the track in a working direction and comprising:

an excavating car including a vertically adjustable track lifting device and a ballast pick-up device;

a screening car disposed ahead of said excavating car in the working direction; and a track measurement system comprising:

a first measuring chord associated with said screening car and a second measuring chord associated with said excavating car, said second measuring chord having a rear end point with reference to the working direction;

a first versine sensor associated with said first measuring chord, and a second versine sensor associated with said second measuring chord; and a displacement measurement device and a memory unit for storing, in dependence on a distance travelled, a measurement value registered by said first versine sensor and for comparing said measurement value to a measurement value registered by said second versine sensor.

* * * * *